US005570801A

United States Patent [19]

Younger

[11] Patent Number: 5,570,801

[45] Date of Patent: Nov. 5, 1996

[54] BARLESS CARGO CONTAINER COVER COMBINATION

[75] Inventor: Phillip E. Younger, Smyrna, Ga.

[73] Assignee: Delta Air Lines, Inc., Atlanta, Ga.

[21] Appl. No.: 544,216

[22] Filed: Oct. 17, 1995

[51] Int. Cl.[6] ..... A47H 3/00

[52] U.S. Cl. ..... 220/1.5; 160/328; 220/315

[58] Field of Search ..... 160/328, 329; 220/1.5, 287, 315, 319, 9.1

[56] References Cited

U.S. PATENT DOCUMENTS

| | | | |
|---|---|---|---|
| 2,223,145 | 11/1940 | Wise | 160/329 |
| 3,099,313 | 7/1963 | Peck et al. | 160/328 |
| 3,456,828 | 7/1969 | Busha et al. | 220/1.5 |
| 4,046,186 | 9/1977 | Nordstrom . | |
| 4,210,191 | 7/1980 | Li | 160/328 |
| 4,428,491 | 1/1984 | Mittelmann et al. | 220/1.5 |
| 4,538,663 | 9/1985 | Looker . | |
| 4,574,968 | 3/1986 | Mittelmann | 220/1.5 |
| 4,795,047 | 1/1989 | Dunwoodie . | |
| 4,799,600 | 1/1989 | Gunn et al. . | |
| 4,936,477 | 6/1990 | King et al. . | |
| 5,046,545 | 9/1991 | Loomis et al. | 160/328 |
| 5,242,070 | 9/1993 | Bretschneider et al. . | |
| 5,377,856 | 1/1995 | Brierton . | |
| 5,395,682 | 3/1995 | Holland et al. . | |

*Primary Examiner*—Stephen J. Castellano

*Attorney, Agent, or Firm*—David H. Semmes

[57] ABSTRACT

A secure barless cover for cargo container portal/opening consisting of flexible, durable, lightweight, weatherproof fabric sized to correspond with the opening, permanently secured across the top edge of opening and incorporating a single, continuous loop cable in conjunction with simple hooks and a single point cable tensioning assembly to secure the cover to the top, bottom and side edges of the container opening. The cover is fitted with grommets and cable pockets along the bottom and sides to allow the cable to weave through the cover from front to back. Continuous looping of the cable is created via use of a cable clamp that enables length adjustment and is secured in place after the cable has been woven through the cover grommets and pockets, hooks and tensioning assembly. Cable exposure to the cover's front is minimal, to allow hooks to hang in easily accessible, strategic positions for attachment to the container opening bottom and sides when securing the cover to the container. The cable pockets are positioned along the back of the cover to keep the cable in its proper configuration and protect it from entanglement with commodities placed in the container. The cable is tensioned via a single tensioning strap with one end secured midway along the top of the container portal/opening and the other end interlooped with the cable. Pulling the strap in a downward direction, using the end secured to the container frame as leverage, with the hooks in position along the frame or portal side braces, tensions the cable and secures the cover along the container's bottom and sides.

10 Claims, 2 Drawing Sheets

BARLESS CARGO CONTAINER COVER COMBINATION

BACKGROUND OF INVENTION

Shipment of cargo often occurs via containerized units, i.e., cargo containers. Pre-loaded containers offer handling efficiency and security during transportation. As compared to individual handling of multiple items on site at the transportation medium, containers are more easily and conveniently loaded apart from the medium, delivered to the medium where they are rapidly and efficiently loaded as a single unit and later, similarly unloaded at their respective destinations. The containers also offer security from theft, protection against handling damage and weather for the cargo while en route. Originally, container openings were typically covered by rigid doors to provide conventional sealing and safeguards against cargo shifting, weather, etc. Many problems are associated with rigid doors, for example: Differing flexing tolerances of the doors versus tolerances of the container bodies tend to result in door or frame warpage, destroying sealing integrity and even use of the doors themselves, thereby putting containers out of service and impeding their revenue generating value. Consequently, increased use of fabric doors or covers has evolved to reduce container unit costs, such as those related to purchase, maintenance, and shipping weights. In the known art, many fabric covers/doors incorporate one, two, or even three horizontal rigid bars, with the bottom bar, typically incorporating a latching device such as a spring-loaded bolt action slide within the bar itself or within the container opening side support. These door bars and the associated latching devices cause an inordinate amount of damage, for example: If the bottom bar is not properly secured, the door will flap and swing over the container when towed, spearing holes in the top of the door and possibly bending the bar or locking bolt. Bars/latches tend to jam in the closed position. To gain access to the inside of such containers, it is not uncommon to slash the door canvas or force forklift tines under the bar and jerk it open, often bending the bar, the lock bolt, or the container side brace, any of which will take a container out of service.

Along with bars, some fabric covers/doors incorporate tension springs located in pockets sewn onto the covers. When the bottom bar is unlatched, the cover is supposed to automatically roll up and out of the way for container loading. These covers offer even more problems than bar doors without tension springs and tend to be more expensive. The springs will tend to lose tensile strength or to become twisted, resulting in the door rolling only part way up, thereby blocking access to the interior of the container and leading to increased loss of container service and maintenance. Furthermore, if the bottom bar is not secured and the door swings over the container while being towed, damage to the container and the door itself is exacerbated.

Other container covers, most closely related to this invention, are of fabric without bars, but they incorporate elaborate, complicated, and costly devices for securing the covers to the container. Such containers typically incorporate a multitude of tensioning devices, interconnected with a series of fabric cross-webbing. Multiple tensioning devices increase handling time during door opening and closing, and amplify the amount of maintenance required. Tensioning patterns tend to be more complicated than necessary and/or involve individual segments. Hooking mechanisms on these covers tend to be flimsy, difficult to engage, or subject to excessive maintenance. Fabric strapping also tends to increase tensioning device wear and tear and subsequent maintenance due to chafing against metal corner points. Outstanding in the prior art is the following.

PRIOR ART

| INVENTOR | DATE | U.S. Pat. No. | DESCRIPTION |
|---|---|---|---|
| Nordstrom | Sept. 6, 1977 | 4,046,186 | Cargo Container Opening Cover |
| Looker | Sept. 3, 1985 | 4,538,663 | Cargo Container |
| Dunwoodie | Jan. 3, 1989 | 4,795,047 | Container and Construction |
| Bretschneider et al. | Sept. 7, 1993 | 5,242,070 | Freight Container |
| Brierton | Jan. 3, 1995 | 5,377,856 | Air Cargo Security Vault |
| Holland et al. | March 7, 1995 | 5,395,682 | Cargo Curtain |

SUMMARY

Responding to the problems expressed hereinabove, the purpose of this combination invention, is to provide a simple, lightweight, low maintenance, cost effective cargo container cover/door that offers adequate commodity protection and can be easily, readily, and adequately secured to the container.

Other objects include: a) providing a simple, effective, time efficient method for securing covers to cargo containers; b) providing a lightweight cargo container opening cover that is flexible, durable, and weather resistant; c) providing a cover for cargo container openings that requires little maintenance, frequency-wise and is economical to maintain when required; d) a cargo container cover combination that allows containers to remain in service longer, when inflicted with otherwise disabling minor degrees of damage.

These and other objects of this invention are achieved by a simple, low maintenance, effective, secure cover for cargo container openings consisting of flexible, durable, lightweight, weatherproof fabric sized to correspond with the opening, permanently secured across the top edge of container portal/opening and incorporating a unique single, continuous loop cable in conjunction with simple hooks and a single point cable tensioning device to secure the cover to the bottom and side edges of the container opening. The cover is fitted with grommets and cable pockets along the bottom and sides to allow the cable to weave through the cover from front to back. Continuous looping of the cable is created via use of a cable clamp that enables length adjustment and is secured in place after the cable has been woven through the cover grommets and pockets, hooks and tensioning device. Cable exposure to the cover's front is minimal, to allow tensioning hooks to hang in easily accessible, strategic positions for attachment to the container opening bottom and sides, when securing the cover to the container. Cable pockets are positioned along the back of the cover to keep the cable in its proper configuration and protect it from entanglement with commodities placed in the container. The cable is tensioned via a single tensioning strap with one end secured midway along the top of the container frame opening and the other end inter-looped with the cable. Pulling the strap in a downward direction, using the end secured to the container frame as leverage, with the hooks in position along the frame, tensions the cable and secures the cover along the container's bottom and sides.

DETAILED DESCRIPTION OF THE INVENTION

Figure 1:
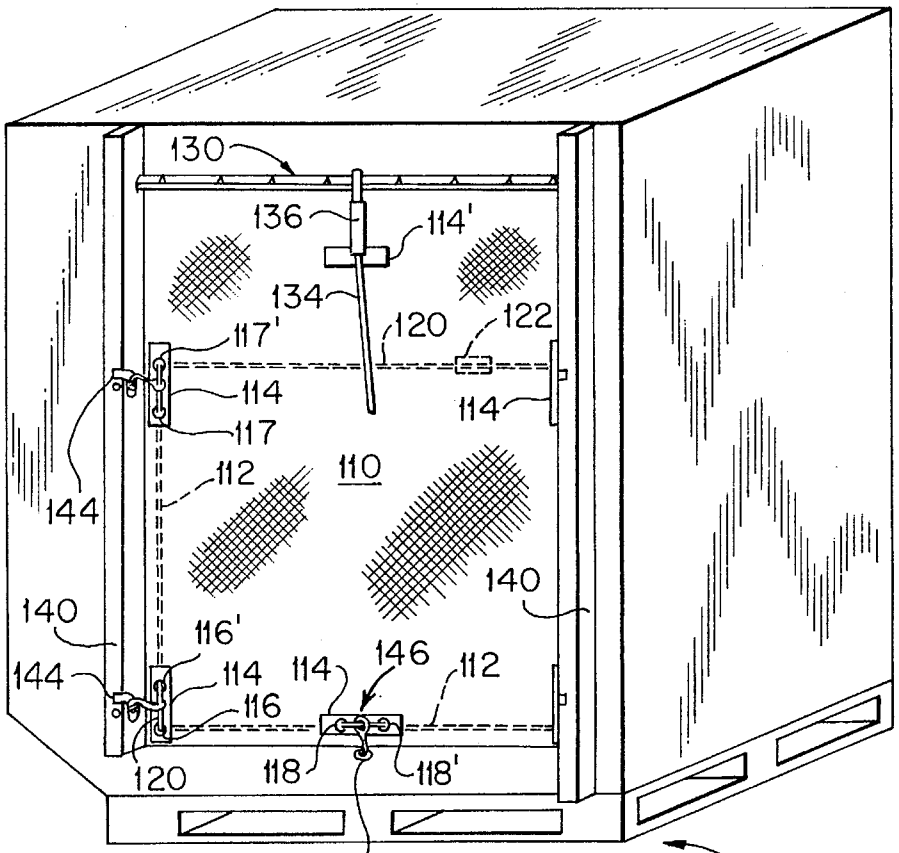
FIG. 1 depicts the combination container-cover in a frontal perspective view.
Figure 4:
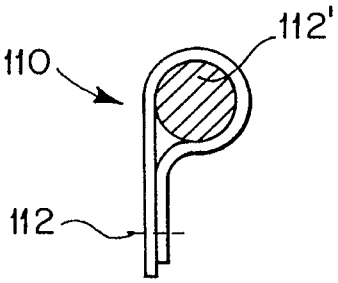
FIG. 4 depicts in section the top and bottom hems of the cover, taken along the lines 4—4 of FIG. 1.

Referring to the drawings, FIG. 1 depicts a typical rigid cargo container 100 having enclosed top, bottom and sides, the front thereof defining a portal, in frontal view. The container fabric cover 110 of the present invention is positioned upon the container portal, yielding opening and closing access to its inside, and comprises a fabric having top, bottom and vertical edge or side hems 112. Referring to FIG. 4, top and bottom hems 112 are formed by folding over, doubling back and stitching an extended edge portion of the cover 110. Sheathed within the top hem is a flexible elastomeric/rubber extrusion 112' about one-fourth inch in diameter and equal in length to the width of the cover fabric. See FIG. 4. Bottom hem 112, also having an extrusion 112', is formed in the same manner, whereas vertical edge hems being likewise formed, do not incorporate extrusions therein.

Lower edge grommets 116—116' are strategically positioned on both sides, front to rear of the cover 110 and reinforced with webbing patches 114. See FIG. 2. Threaded through the sets of continuous loop grommets 116–117–118 is an endless cable 120. This cable is preferably composed of a plastic coated wire, the ends of which are joined by clamp 122, thus permitting length adjustment to the cable. Cable 120 is also threaded through strap tension means 130, more specifically a through tensioning strap ring 138. All grommets are reinforced with webbing patches 114 stitched to the front and back of the cover fabric. In general, patches 114 are all sized to encompass grommets in pairs of two, in closest proximity to each other, consistent with utility as cable 120 guides. Grommets 118—118' are located about mid-point along the bottom edge of the fabric. The bottom-most vertical edge grommets 116—116' are thus located in line with the horizontal plane of the bottom edge mid-point grommets 118—118'. The second bottom-most vertical edge grommets 116' are located a few inches above and in line with the vertical plane of the bottom-most vertical edge grommets 118—118'. The upper-most vertical edge grommets 117 are located about mid-point or slightly higher along the vertical edge of the cover fabric and in line with the vertical plane of the bottom-most vertical edge grommets 116—116'. The second upper-most vertical edge grommets 117' are located a few inches below and in line with the vertical plane of the upper-most vertical edge grommets 116—116'. A transversely elongated grommet 119 not shown is located on webbing patch 114' about one foot down from the mid-point of the top edge of the fabric cover 110.

Figure 2:
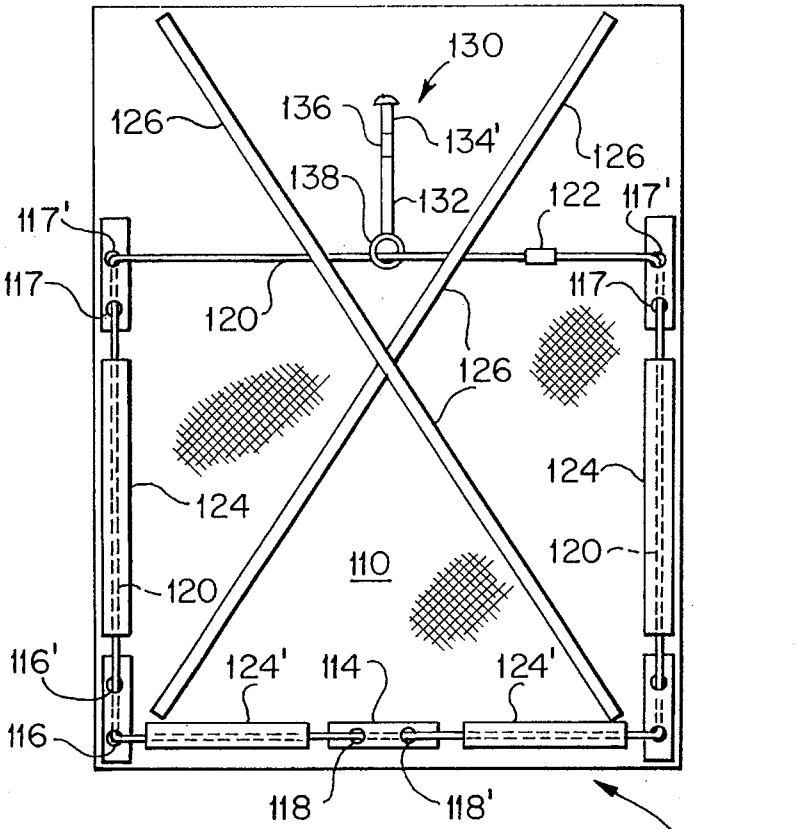
FIG. 2 depicts a schematic rear elevation of the cover, its reinforcing and container securing elements.

Referring to FIG. 2, a rear view of the cover 110, cable pockets 124, composed of webbing-like material, similar to grommet reinforcement webbing patches 114, are positioned on each vertical edge of lower portion of cover fabric 110. These pockets 124 extend about the entire length between the bottom-most and upper-most vertical edge grommet reinforcement webbing patches 114 and are stitched along their vertical edges to the cover 110. Lower-most cable pockets 124' composed of webbing like or similar to the grommet reinforcement webbing patches 114, are positioned on the bottom edge of the cover fabric. Cable pockets 124' extend about the entire length between the bottom-most vertical edge and the bottom-most mid-point grommet reinforcement webbing patches 114 and are stitched along their horizontal edges to the cover fabric 110. Cross-support reinforcement straps 126 are stitched to rear of cover 110. One cross-support reinforcement strap 126 extends from approximately the left upper-most corner to the right bottom-most corner of the cover; the other cross-support strap 126 extends from approximately the right upper-most corner to the left bottom-most corner of the cover. Each cross-support strap 126 is stitched to the rear of the cover along the edges, for approximately two feet, beginning from the upper-most corner downward and for approximately three feet beginning from the bottom-most corner upward. Non-stitched portions of respective cross-support straps 126 must exist, beginning at a point in line with the horizontal plane between the upper-most vertical edge grommets 117 and extend to a point in line with a parallel horizontal plane at least one foot above the horizontal plane between the upper-most vertical edge grommets 117'. These non-stitched portions permit protected tensioning of the cable 120, as explained hereafter.

As indicated, plastic coated wire cable 120 of approximately one-eighth inches in diameter is threaded through the grommet sets 116–117–118 and cable pockets 124—124' such that frontal exposure of the cable occurs only on the front of the cover hem between the first bottom-most vertical edge grommets 116 and the second bottom-most vertical edge grommets 116' and the bottom edge mid-point grommets 118—118'. See FIG. 1. Sheathing of the cable 120 at the rear of the cover occurs within the vertical cable pockets 124. See FIG. 2. As cable 120 extends from the upper-most left vertical edge grommet 117 to the upper-most right vertical edge grommet 117, it is threaded through ring 138 attached to the tensioning strap 132, being positioned between the cross-support straps 126 and the cover 110. When the cable completes a full loop back to its point of origin, adjacent right-hand grommets 117', the ends are secured together via cable clamp 122, which defines both start and finish of the cable 120. See FIGS. 1 and 2.

Referring in general to strap tension means 130 for cable 120 146, a tensioning strap 132—132' extends through the cover from rear to front and is secured at the mid-point of the edge of the portal of container body 100. See FIGS. 1 and 2. After passing through to the front of the cover 110, the tensioning strap 132—132' is threaded through a releasable latch 134, that latch automatically holding strap 132—132' in position when the strap is tightened and releasing strap tension when a release mechanism of the latch 134 is pressed. One end of strap 132 is attached to the releasable latch 134 and the other end is secured to the mid-point of the edge of the opening of the container body 100. The strap 132 has a cable engaging ring 138 at its free end. Rigid, round eye hooks 146 are threaded by the cable 120 as it extends through a grommets 116–118 to the front of the cover and proceeds to extend through the closest proximity grommet to the rear of the cover. Subject rigid, round eye hooks 146 are positioned between the upper-most vertical edge and second upper-most vertical edge grommets, the bottom-most vertical edge and second bottom-most vertical edge grommets, and the bottom edge mid-point grommets, all shown in FIG. 2. The strap 132 is tensioned and released by its threading ring 138.

Figure 3B:
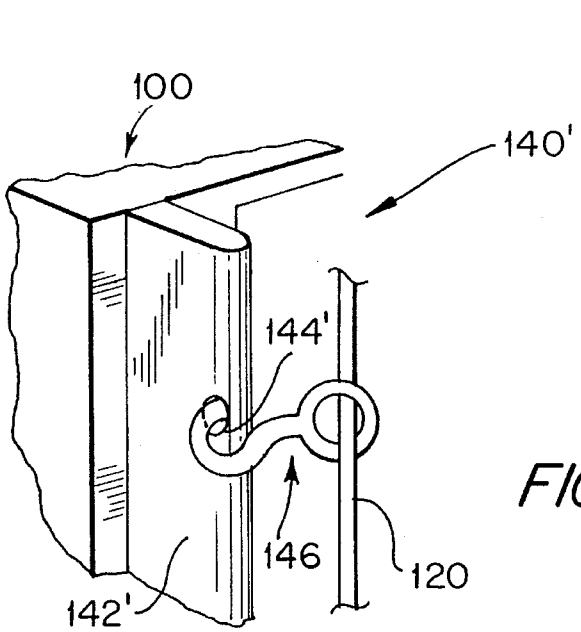
FIG. 3B depicts in partial perspective an alternate narrow side brace of the container portal with attached tensioned cable and eye hooks.
Figure 3A:
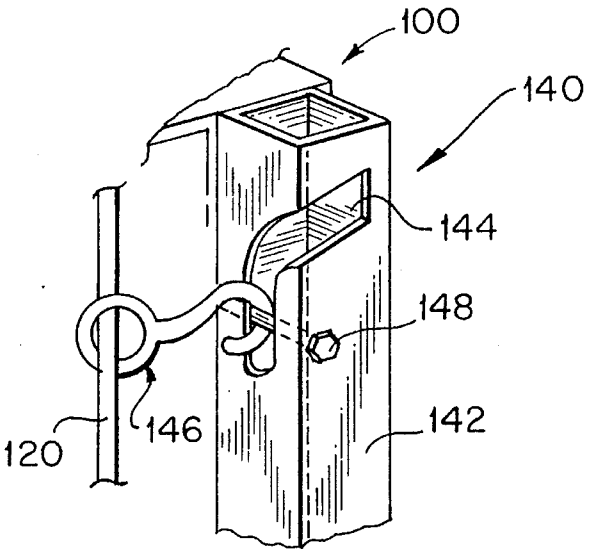
FIG. 3A depicts in partial perspective the wide side brace of the container portal including the tensioned cable and eye hooks relative to one side brace of the container.
Figure 3C:
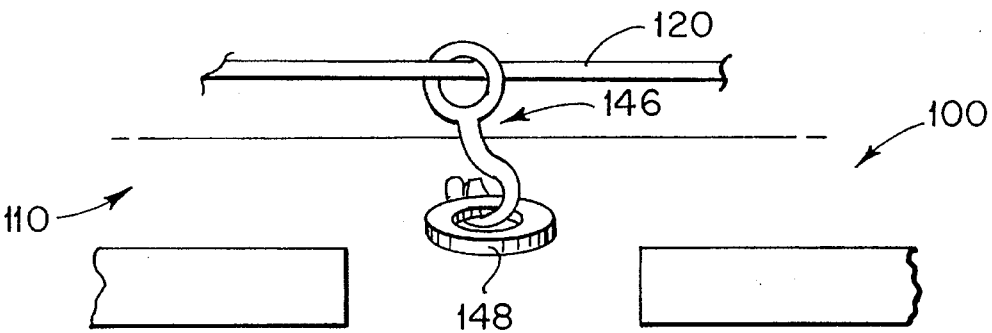
FIG. 3C depicts a bottom eye bolt anchor of the container with cable threaded eye hook.

Referring to FIGS. 3A–B, rigid round eye hooks 146 are secured selectively at anchor posts 140—140' to the container 100 by attachment to the portal side braces 142—142' or portal mid-point bottom edge of the container 100, as at FIG. 3C. Side braces 142—142 are comparatively wide, whereas side braces 142'—142' are narrow, see FIGS. 3A and 3B respectively. This may occur several ways, e.g., placing the hook end of these hooks 146 over a bolt 148 inserted into an open notch 144 in the portal side brace 142 of the container in a notch or hole in a notch or hole. See FIGS. 3A and 3B. In FIG. 3B, a similar portal anchorage is depicted for braces 142' of thinner dimension, an anchor hole 144' receiving the hook end of element 146. Again, FIG. 3C illustrates attachment of round eye hook 132 to the fixed eye bolt anchor 148, for resistance of cable 120 against the action of tensioning assembly 130.

Having defined the invention with reference to prior art, the specification and drawings, the invention in its scope is defined with reference to the claims, hereinafter.

I claim:

1. In combination with a rigid cargo container having a portal with pairs of anchor posts thereon, the anchor posts defining spaced apart side braces, a) a fabric cargo container cover for the portal including plural grommets adjacent edges of the cover for engagement by tensioning eye hooks;

b) a continuous loop flexible cable threaded through the grommets of the cover and the eye hooks for removable securement of the cover to the container and portal side braces thereof;

c) a single point cable tension station mounted upon the cover, said tension station including a holding strap with a ring at a free end thereof, the cable being threaded through tension strap ring to render the cover taut over the portal, upon pulling the strap up.

2. The combination of claim 1 wherein the cable threads a taut cover pattern within cable pockets on the rear of the cover, to return the cable to its origin, ends of the cable being connected by a cable length adjusting clamp.

3. The combination rigid cargo container of claim 2 wherein the cover is reinforced by webbing patches, adjacent bottom and side edges thereof, said patches securing grommets thereto in an eye hook cover tension pattern which is substantially coextensive with at least a lower portion of the portal of container.

4. The combination of claim 3 with a rigid cargo container including a fixed bottommost anchor secured to the container, the bottommost anchor comprising an eye bolt.

5. The combination of claim 4 wherein the side braces define in spaced apart array, plural seats for anchorage of eye hooks, disposed along vertical edges of the cover.

6. The combination according to claim 5 wherein the side braces define at least one vertically disposed eye hook notch with anchor means to anchor respective eye hooks.

7. The combination according to claim 5 wherein the side braces define at least one outside aperture to provide a hook engaging anchor for respective eye hooks.

8. The combination according to claim 5 including right-hand and left-hand cable pockets on sides and bottom of the cover, said pockets being disposed between corresponding sets of webbing patches and grommets.

9. The combination of claim 8 further including cross-support reinforcement straps extending respectively from uppermost corners of the cover to bottom-most corners thereof, each said strap being stitched to the cover such as to delineate non-stitched portions of said cross straps, beginning at a point in line with a horizontal plane between uppermost vertical edge grommets and extending to a point which is in line with a parallel plane sufficient to permit excursion of the cable upon the application of tension thereto.

10. The combination of claim 9 wherein the cover is reinforced at top and bottom by an elastomeric extrusion contained within hems of the cover.

* * * * *